United States Patent [19]

Anderson

[11] 4,066,129

[45] Jan. 3, 1978

[54] SPRINKLER HEAD ASSEMBLY

[75] Inventor: James R. Anderson, Berwyn, Pa.

[73] Assignee: Central Sprinkler Corporation, Lansdale, Pa.

[21] Appl. No.: 724,736

[22] Filed: Sept. 17, 1976

[51] Int. Cl.[2] ..... A62C 37/10; F16L 37/24

[52] U.S. Cl. ..... 169/37; 169/42; 285/158; 285/402

[58] Field of Search ..... 169/37–42; 239/288.5; 285/46, 158, 361, 402

[56] References Cited

U.S. PATENT DOCUMENTS

| | | | |
|---|---|---|---|
| 1,279,935 | 9/1918 | Sweat | 285/402 X |
| 1,719,371 | 7/1929 | Holt et al. | 169/40 |
| 2,389,334 | 11/1945 | Tyden | 169/40 |
| 2,896,977 | 7/1959 | Hansen | 285/402 X |
| 3,393,746 | 7/1968 | Hodnett | 169/41 |
| 3,986,733 | 10/1976 | Esser | 285/158 |
| 3,998,273 | 12/1976 | Juliano | 169/37 |
| 4,014,388 | 3/1977 | Anderson | 169/37 |

*Primary Examiner*—Evon C. Blunk
*Assistant Examiner*—Andres Kashnikow
*Attorney, Agent, or Firm*—Fishburn, Gold & Litman

[57] ABSTRACT

A sprinkler is disclosed which comprises a flange attached to a bracket on the sprinkler body by means of boss and shoulder joints, e.g. bayonet joints. The flange can serve as a bracing means which prevents sagging of ceiling tile or unwanted retraction of the sprinkler head rearward of an opening in a sidewall. When used with recessed sprinklers, a cover plate can be attached to the flange with a bonding material having a low softening point. By means of the boss and shoulder joints, the flange and the attached cover plate can be easily mounted on the sprinkler as a subassembly, and can be just as easily removed therefrom for inspection and/or servicing of the sprinkler.

15 Claims, 9 Drawing Figures

Fig. 1.
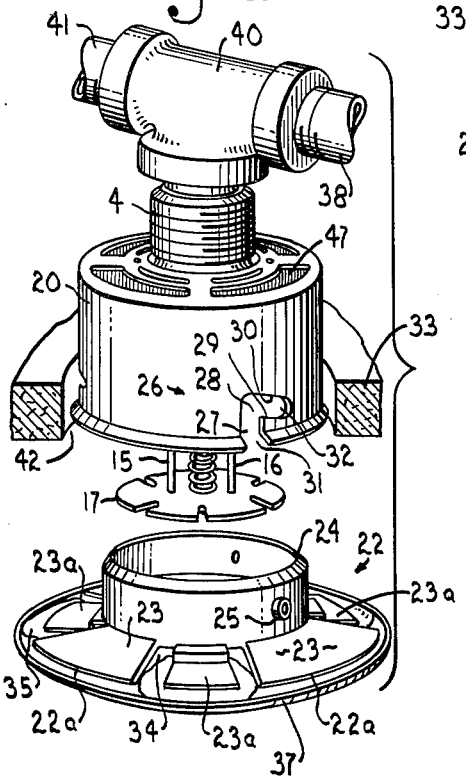
Fig. 2.
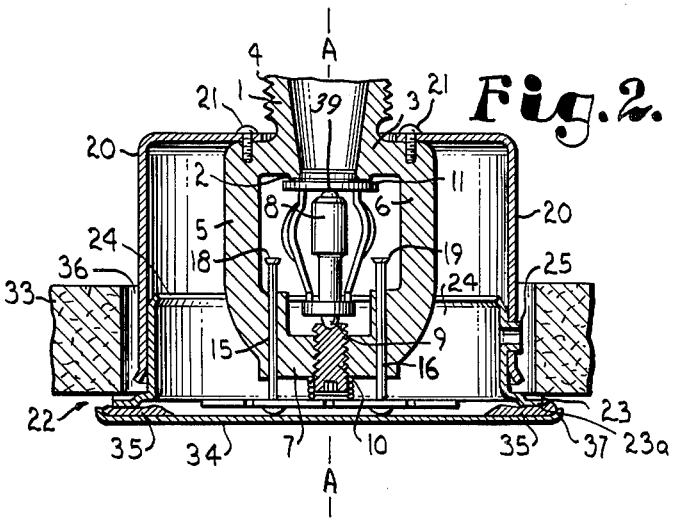
Fig. 3.
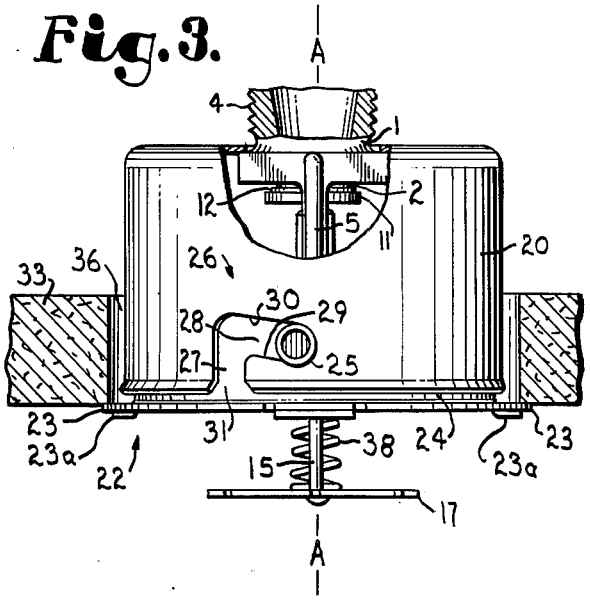
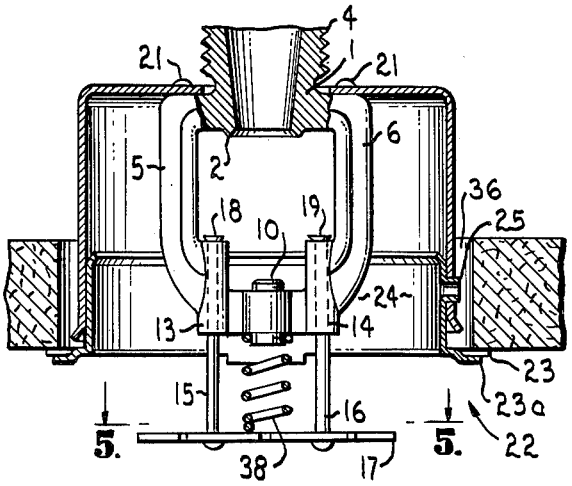
Fig. 4.
Fig. 5.
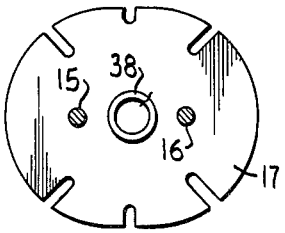

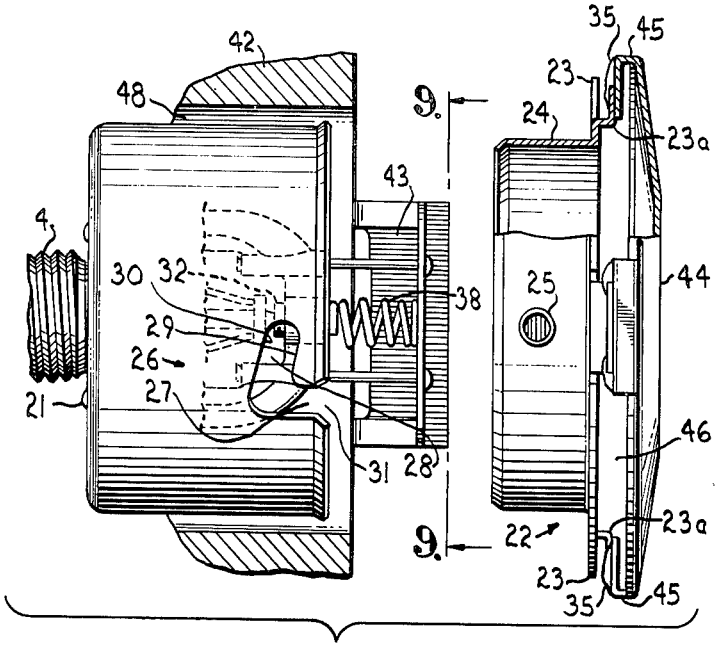
Fig. 6.
Fig. 7.
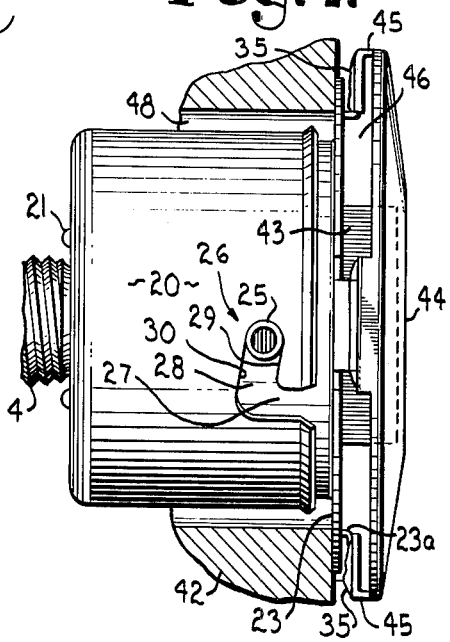
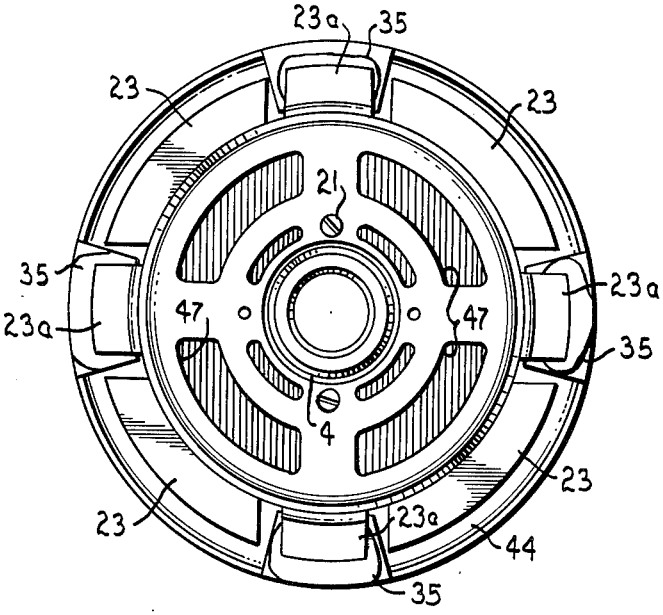
Fig. 8.
Fig. 9.
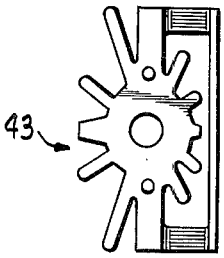

SPRINKLER HEAD ASSEMBLY

Applicant relies on the filing date of copending application Ser. No. 698,479, now U.S. Pat. No. 4,014,388.

BACKGROUND OF THE INVENTION

The present invention pertains to improvements in sprinklers employed with sprinkler systems which are installed in structures for protection against fire, and more particularly pertains to improvements in such sprinklers which are provided with a flange or ring thereon for covering an opening in a ceiling or a sidewall in which the sprinkler is mounted.

When installing the sprinkler heads of a fire-protection sprinkler system, holes are formed in the ceiling and/or walls of a room, and each hole is centered with respect to a corresponding sprinkler head which either lies behind the opening or extends partially or entirely through it. Since these holes are unfilled, or are only partially filled by the sprinkler head, flanges and/or detachable cover plates have been used as escutcheons for covering the openings. Such flanges and/or cover plates used in combination with sprinkler heads are disclosed, for instance, in U.S. Pat. Nos. 2,389,331; 2,389,332; 2,534,066; 2,558,450; 3,198,258; 3,393,746; 3,459,266; 3,714,989 and 3,815,821. From these patents it can be seen that the flanges and/or cover plates disclosed therein for closing the openings around the sprinkler heads have little or no bracing effect with regard to supporting adjacent ceiling tile, or which prevents retraction of the sprinkler head from the opening, or else the flange is attached to the sprinkler head permanently or by means of threads, screws, nuts and bolts, coiled springs, or relatively insecure friction clasps. When the flange is permanently attached to a concealed sprinkler head, it can complicate the installation thereof, and the flange cannot be removed for inspection of the head.

Attachment of the flange to the sprinkler head by means of threads, screws, springs, and the like is costly and time consuming, and removal and reattachment of the flange for inspection of the head can be slow and cumbersome. Use of a friction clasp provides a rapid and simple means for attaching and detaching the flange, but does not provide a positive lock which prevents dislodgement of the flange as a result of vibration or shifting of the sprinkler system or the structure being protected against fire.

SUMMARY OF THE INVENTION

It is therefore an object of the present invention to provide a sprinkler head having a flange thereon whereby the aforementioned disadvantages associated with prior sprinkler heads are avoided.

Another object is to provide a sprinkler head having a quickly and easily operated interlocking means whereby a hole-covering flange can be selectively attached to the sprinkler head and detached therefrom.

Still another object is to provide a sprinkler head having a flange thereon which serves as a brace that prevents sagging of adjacent ceiling tile, or that prevents retraction of the sprinkler head from an opening in a sidewall of a structure being protected against fire.

Yet another object is to provide a concealed sprinkler head having a flange with a detachable outer cover plate thereon, and wherein said flange and cover plate can be selectively attached to the sprinkler head and removed therefrom as an integral subassembly by means of a quickly and easily operated interlocking means.

Other objects and advantages of the present invention will become apparent from the following description and the drawings.

The present invention is a sprinkler comprising a sprinkler body having a nozzle therein, a bracket attached to the sprinkler body, and a flange that is located forwardly of said nozzle while being disposed substantially transversal and extending laterally outward with respect to the discharge axis of the nozzle. The flange is attached to the bracket by means of at least one rotatively engageable boss and shoulder joint, e.g. a bayonet joint.

BRIEF DESCRIPTION OF THE DRAWINGS

FIG. 1 is a partially exploded perspective view of a flush, ceiling mounted sprinkler constructed in accordance with the present invention.

FIG. 2 is a side sectional view of the sprinkler shown in FIG. 1.

FIG. 3 is a side view, shown partly in section, of the sprinkler shown in FIGS. 1 and 2.

FIG. 4 is a side sectional view of the sprinkler in operating condition following outward extension of the deflector and discharge of the thermally responsive element therefrom.

FIG. 5 is a top view of the deflector used with the sprinkler shown in FIGS. 1–4.

FIG. 6 is a partially exploded side view of a sidewall, flush mounted sprinkler constructed in accordance with the present invention.

FIG. 7 is a side view of the sprinkler of FIG. 6, and shows the sprinkler in a fully assembled state.

FIG. 8 is a view of the inner end of the sprinkler shown in FIGS. 6 and 7.

FIG. 9 is a view of the outer end of the deflector used with the sprinkler shown in FIGS. 6–8.

DESCRIPTION OF PREFERRED AND ALTERNATIVE EMBODIMENTS

The term "rotatively engageable boss and shoulder joint" as used herein is intended to mean a joint whereby two members can be selectively engaged in an interlocking relationship by partial rotation of one of the members for abutment of at least one boss thereon with a corresponding shoulder on the other member, whereby axial movement of the rotated member is prevented until it is partially rotated in the opposite direction for displacement of the boss from the shoulder.

One example of a boss and shoulder joint is a bayonet joint such as is used with pin and socket electrical connections, especially light bulbs. Boss and shoulder joints will thus frequently involve insertion of bosses on a first member into channels in a second member, followed by axial movement of the first member so that the bosses pass through the channels until the first member can be rotated for abutment of the bosses with transversally extending shoulders, and whereafter further axial movement of the first member is prevented and the two members are thereby interlocked until the first member is partially rotated in an opposite direction for displacement of the bosses from the shoulder.

Unless otherwise indicated, the terms "inner," "outer," "inwardly," "outwardly," "rearwardly" and "forwardly" as used herein are with reference to the general direction in which the nozzle of the sprinkler is pointed, e.g. the nozzle is pointed outwardly and liquid is jetted forwardly therefrom.

As shown in FIGS. 1-5, the sprinkler comprises a body 1 having a nozzle 2, a yoke frame 3 and a threaded connector 4 thereon. The yoke frame comprises two arms 5 and 6 which extend away from the nozzle longitudinally with respect to the discharge axis A—A thereof, and the arms merge at junction 7 in front of the nozzle. Located between nozzle 2 and junction 7 is a thermally responsive element 8 of the frangible pellet type. The outer tip 9 of the element rests in a socket in the inner end of the set screw 10. The inner end of the element is a cap 11 and a polymeric or soft metal disc 12 is placed between the cap and the nozzle to provide a seal against leakage of a fire extinguishing fluid, such as water, that is supplied through connector 4 from a pipe tee 40 and supply pipe 41. The pressure applied to the disc 12 by means of the cap 11 of the element is regulated by turning the set screw 10.

The arms 5 and 6 of the yoke frame have channels 13 and 14 therein which are parallel to the discharge axis A—A of the nozzle 2. Rods 15 and 16 extend through these channels and are slidable inwardly and outwardly therein. One end of the rods is attached to the deflector plate 17, whereas the other end has slide stopping means 18 and 19, e.g. retaining heads, to prevent passage of the rods through the channels, and thereby serving as means for retaining the deflector plate on the sprinkler head.

As shown in FIGS. 1-9, the entire sprinkler head, excepting the connector 4, is contained within a hollow cylindrical socket 20 that is stationarily mounted on the sprinkler body 1 by means of screws 21. Socket 20 thus serves as a bracket for mounting of flange 22 on the sprinkler, and the flange is located forwardly of the nozzle and is disposed transversally and extends laterally outward with respect to the discharge axis thereof. The flange shown in the drawings is an annular flange, i.e., a generally ring shaped flange having a circular central opening therein which is aligned axially with the discharge axis A—A of the nozzle. As shown in FIGS. 1-9, the flange 22 comprises a plurality of rigid fins 23 and 23*a* which extend radially outward from a ring 24 of the flange that serves as a mount for the bosses 25 thereon. The ring mount 24 projects axially inward when attached to bracket 20, and originates from the flange inwardly of the outer periphery 22*a* thereof.

Socket 20, which serves as a mounting bracket for the flange 22, comprises angular channels, generally represented at 26, which have an axially extending portion 27 and an adjoining portion 28 that extends at an angle sideways between an outer shoulder 29 and an inner shoulder 30. When used with a concealed sprinkler as shown in FIGS. 1-9, the socket 20 can have an inside diameter which accomodates the outside diameter of the ring mount 24, so that the ring mount can be inserted into the socket when the bosses 25 thereon are aligned with the axially extending portion 27 of the channels 26.

Following insertion of the bosses into the channels, the flange is then rotated around axis A—A for only a small part of a full turn in order to move the bosses 25 into the sideways extending portions 28 of the channels so that the bosses are abutted with the outer and inner shoulders 29 and 30. As shown in the FIGS. 1-9, the portion of the channels 28 which extends sideways, or transversally, can also be sloped with respect to the axially extending portion at an included angle of less than 90° when measured from the outer end 31 of the channel toward the inner end 32. Accordingly, the flange 22 becomes interlocked with the socket 20 and cannot be dislodged therefrom unless rotated in the opposite direction for realignment with the axially extending portion 27 of the channels. Secure interlocking which can only be overcome by deliberate reverse rotation of the flange can be further assured by use of the previously mentioned acute angle relationship between the two portions of the channels.

Referring to FIGS. 1 and 2, a concealed or recessed sprinkler is illustrated which is mounted in the ceiling tile 33 of a structure being protected against fire. The sprinkler includes an outer cover plate 34 which is attached to the fins 23*a* of the flange by means of a bonding material 35 having a low softening point, e.g. a solder which melts at about 135° F. The flange 22 and the cover plate 34 thus form an integral subassembly which can be attached to the sprinkler head, by means of boss and shoulder joints, in order to conceal the sprinkler and the annular opening 36 around it. As can be seen from the drawings, fins 23*a* of the flange can be angled so that they extend outwardly beyond the fins 23. Accordingly, the fins 23 abut the ceiling, but not fins 23*a*, since the purpose of the latter is to space the rim 37 of the outer cover plate 34 away from the ceiling surface so that the cover plate is not caused to adhere to the ceiling by a film of paint, thereby allowing the ceiling and the cover plates to be painted at the same time without having to remove the subassembly comprising the flange and the cover plate, while also protecting working parts of the sprinkler against coating by paint as might interfere with its proper activation in the event of fire.

With the cover 34 fastened onto the sprinkler as shown in FIG. 2, the deflector plate 17 is held inwardly by the cover in a normally retracted position adjacent the junction 7 of the yoke arms, and a compressed spring 38 between the junction and the deflector continuously urges the deflector 17 and the cover 34 outwards. Should a fire occur within an enclosed space wherein the sprinkler is located, the heat from the fire will first soften or melt the solder that is holding cover 34 on the flange 22, the solder joints 35 will thus loosen so that the lid can detach from the flange and drop off, with detachment from the flange being aided by pressure exerted from the compressed spring 38. Upon detachment of the lid, the pressure of the spring 38 also causes the deflector to slide outward into an operating position as indicated in FIGS. 3 and 4. Subsequently, the frangible pellet of the thermally responsive element 8 will melt, whereupon ball 39 will retract into the element so that holding pressure on the disc 12 and cap 11 will be released, allowing water supplied by line 38 to be discharged from the nozzle 2. Following thermal activation of the element 8, it is knocked aside and thrust out of the socket 20 by the water so that a substantially solid stream thereof can be directed onto the upper surface of the extended deflector plate 17, thereby atomizing the water stream and producing a desired pattern of droplet distribustion by the sprinkler. As was previously indicated, the flange 22 serves as a brace which supports the ceiling tile 33 above the deflector 17 during operation of the sprinkler, for the tile may otherwise partially collapse as a result of becoming wet and in which case it might seriously interfer with the proper spraying of water by the sprinkler.

Other features of the sprinkler enclosure and the flush mounting thereof are shown in the drawings, especially FIG. 1. When installing the sprinkler, the tee 40 in water line 41 is aligned over a hole 42 cut in the ceiling tile 33. A first assembly comprising the sprinkler body, the thermal element, the deflector and spring, and the attached socket are then inserted into the hole, and the connector 4 is screwed into the tee 40. (Where preferred, this first assembly can be connected to the tee prior to alignment with the hole.) A second assembly comprising the flange 22 and the attached cover plate 34 is then inserted into the socket and attached thereto by means of the bosses 25 which insert into the channels 26 to form an interlocking relationship, in the form of a bayonet joint, between the socket and the flange. Although only one boss 25 and channel 26 is illustrated in the drawings, use of two or more of each is preferred for providing a secure and stable interlock.

As can be seen in FIG. 2, interconnection of the flange 22 and the attached cover 34 with the socket 20 of the sprinkler effects compression of spring 38 and movement of the deflector 17 to a fully retracted position. Accordingly, the deflector and the rest of the sprinkler head components are concealed from view by the flange and cover and it should also be noted that the slidable deflector rests on the cover plate 34 and thus continuously urges it and the attached flange 22 outward from the nozzle. This continuous exertion of pressure by the spring 38 aids detachment of the cover from the flange and effects outward extension of the deflector in the event of fire. In addition, it causes the bosses 25 to be firmly held against the outer shoulders 29 of the socket so as to prevent unwanted reverse rotation of the flange and the attached cover plate as might result from continued vibration or expansion and contraction of the sprinkler system or the structure being protected against fire. It will nonetheless be appreciated that the flange-cover plate assembly can be quickly and easily interconnected with the socket of the sprinkler by hand, and can be disconnected therefrom just as quickly and easily for inspection and/or servicing of the sprinkler head.

FIGS. 6–9 illustrate a sprinkler built in accordance with the present invention for flush mounting in the sidewall 42 of a structure being protected against fire. The deflector 43 of this sprinkler has a somewhat different configuration from that shown in FIGS. 1–5, so that a desired pattern of droplets can be discharged laterally into a confined space being protected against fire. Construction and operation of the sprinkler of FIGS. 6–9 is otherwise substantially the same as that shown in FIGS. 1–5, with the additional exception of a cover plate 44 that is somewhat different in being outwardly concaved and having cover plate tabs 45 thereon which extend rearwardly. When these tabs are attached to the flange, e.g. to fins 23*a* by means of a bonding material 35 having a low softening point, a space 46 remains between the cover and the flange. One purpose of this space is to permit circulation of heated air and/or hot combustion gases over the tabs, and through the socket 20 via vents 47 therein, for early melting or softening of the bonded joints 35 and the fusible element 8. Another purpose for leaving the space 46 between the outer cover and the flange is to permit painting of the sidewall 42 while the covers 44 are in place on the sprinklers, and whereby an unwanted film of paint cannot extend from the sidewall onto the covers, for the presence of such a film might hinder early detachment of the covers and early activation of the thermal elements in the event of a fire.

Insertion and removal of the flange-cover plate subassembly from the sprinkler socket of FIGS. 6–7 is accomplished in the same manner as was described with reference to the sprinkler of FIGS. 1–5, and the installed flange and the cover plate serve to conceal the sprinkler and the annular opening 48 in the sidewall around socket 20. In addition, the flange serves as a brace whereby the sprinkler and the attached socket do not retract inwardly, and this is an important feature since inward retraction could result in impingement of at least part of the sprayed water against the inner surface of the sidewall instead of being sprayed through the opening in a droplet pattern deemed necessary for proper protection against fire.

The recessed sprinklers illustrated in FIGS. 1–9 involve use of an outer cover plate 34 or 44 that is attached to the flange 22 by means of a bonding material having a low softening point, as previously described. The flange can comprise outwardly projecting fins such as are represented at 23*a*, or a flat ring having no such fins can be used when such is preferred. In any case, however, cover plate tabs such as are represented at 45 can be used to provide a space between the rim of the cover plate and the outer surface of a ceiling or wall in which the sprinkler is installed. It will also be understood that the cover plates 34 and 44 are not limited for use with ceiling and sidewall sprinklers, respectivly, i.e., either can be adapted for use with ceiling sprinklers or sidewall sprinklers as a matter of choice.

It will be understood that the present invention can be used with either automatic or manually operated sprinkler systems, e.g. when the sprinklers are manually operated, they need not include either or both of the thermally responsive element or the detachable outer cover.

An improved sprinkler which fulfills the previously stated objects has now been disclosed in detail, and although the invention has been described with reference to particular apparatus, combinations and arrangements of apparatus, conditions of use, and the like, it will nonetheless be understood that even other embodiments will become apparent which are within the spirit and scope of the invention defined in the following claims.

What is claimed and desired to secure by Letters Patent is:

1. A sprinkler head for a fire extinguishing system comprising:

a. a sprinkler body having a nozzle therein, said nozzle being closed by a thermally responsive seal member adapted to open said nozzle to permit fluid discharge therefrom, b. a bracket attached to said sprinkler body, c. a flange located forwardly of said nozzle that is disposed substantially transversely and extends radially outward with respect to the discharge axis of said nozzle, and d. a cover extending across the path of said discharge axis and attached to said flange by means of a thermally responsive bonding material which will soften prior to the opening of said nozzle by said seal member, e. said flange being attached to said bracket by means of at least one relatively engageable projection and shoulder joint, said joint having at least one resiliently operative transitional arrangement tending to lock the engaged projection and shoulder of said joint against relative rotational disengagement, f. said resiliently operative transitional arrangement including resilient means urging said cover away from said flange.

2. A sprinkler as in claim 1, wherein said resiliently operatively transitional arrangement comprises at least one sloping transitional section tending to lock the engaged projection and shoulder together against rotative disengagement upon said resilient means urging said cover away from said flange.

3. A sprinkler as in claim 2, wherein said resilient means is a compressed spring.

4. A sprinkler as in claim 2, wherein said bracket is stationarily mounted on the sprinkler body, and said joint comprises a projection on said flange that abuts a shoulder on said bracket.

5. A sprinkler as in claim 4 wherein said flange comprises a mount thereon for said projection, and wherein said mount projects axially rearward with respect to said axis and originates from said flange radially inwardly of the outer periphery thereof.

6. A sprinkler as in claim 5 wherein said mount is a ring mount having a plurality of said projections thereon which project radially outward therefrom and abut corresponding shoulders on said bracket.

7. A sprinkler as in claim 6 wherein said bracket comprises a hollow cylindrical socket into which said ring mount is inserted, said socket having channels adjacent said shoulders and into which said projections are inserted, and whereupon inserting said projections into said channels compresses said resilient means and partially rotating said flange around said discharge axis of said nozzle said flange and said bracket become interlocked, and become unlocked for removal of the flange from the bracket by recompressing said resilient means and partial rotation of the flange in the opposite direction.

8. A sprinkler as in claim 7 wherein said channels comprise a first portion in the wall of said socket which extends axially with respect to said axis, and a second portion which merges with the first portion and extends at an angle sideways with respect to said axis.

9. A sprinkler as in claim 8, wherein the included angle at which the two portions interconnect is less than 90°.

10. A sprinkler as in claim 1, further comprising:

a. a deflector mounted on said sprinkler body and positioned to intercept and divert a stream of liquid discharged from the nozzle, and b. said resilient means bears against said deflector.

11. A sprinkler as in claim 1 wherein said sprinkler body further comprises a yoke frame that is located rearwardly of said flange.

12. A sprinkler as in claim 1 wherein said flange comprises a plurality of rigid fins which extend therefrom and wherein said cover is bonded to said fins.

13. A sprinkler as in claim 1 wherein said cover has a peripheral rim located forwardly of said flange.

14. A sprinkler as in claim 1 wherein said cover has tabs thereon which extend rearwardly of the rear surface of the cover and which are attached to said flange by means of said bonding material.

15. A sprinkler as in claim 1 and further comprising:

a. a deflector which rests against said cover in a normally retracted position to intercept and divert a stream of liquid discharged from the nozzle, the deflector being slidable away from the nozzle with respect to the discharge axis thereof, and b. said resilient means comprises a compressed spring engaging said deflector.

* * * * *